US007156435B1

(12) United States Patent
Mourelatos et al.

(10) Patent No.: US 7,156,435 B1
(45) Date of Patent: Jan. 2, 2007

(54) SNOW SHOVEL

(76) Inventors: Costantinos Mourelatos, 1581 Laurel Hollow Rd., Syosset, NY (US) 11791; Georgios Gouramanis, 76 Maria St., Lindenhurst, NY (US) 11757

( * ) Notice: Subject to any disclaimer, the term of this patent is extended or adjusted under 35 U.S.C. 154(b) by 0 days.

(21) Appl. No.: 10/972,928

(22) Filed: Oct. 25, 2004

(51) Int. Cl.
*E01H 5/02* (2006.01)

(52) U.S. Cl. ..... 294/54.5; 294/57

(58) Field of Classification Search ..... 294/54.5, 294/55, 51, 59, 57
See application file for complete search history.

(56) References Cited

U.S. PATENT DOCUMENTS

| | | | | | |
|---|---|---|---|---|---|
| 815,122 | A | * | 3/1906 | Schaffert | 37/284 |
| 841,848 | A | | 1/1907 | Conner et al. | |
| 1,749,103 | A | * | 3/1930 | Kortick | 403/247 |
| 2,262,648 | A | * | 11/1941 | Peterson et al. | 294/57 |
| 2,511,160 | A | * | 6/1950 | Grobowski | 16/437 |
| 2,565,466 | A | * | 8/1951 | Barker | 294/57 |
| 2,896,993 | A | | 7/1959 | Pollock | |
| 3,198,565 | A | * | 8/1965 | Ellis | 294/54.5 |
| 3,334,939 | A | * | 8/1967 | Bonic | 294/51 |
| 3,549,189 | A | * | 12/1970 | Alosi | 294/57 |
| 3,583,747 | A | | 6/1971 | Lambert | |
| 4,199,181 | A | | 4/1980 | Mason | |
| 4,396,214 | A | * | 8/1983 | Lesche | 294/49 |
| 5,615,970 | A | * | 4/1997 | Reekie et al. | 403/379.1 |
| 5,695,229 | A | * | 12/1997 | Chang | 294/51 |
| 5,975,602 | A | * | 11/1999 | Zan | 294/54.5 |
| 6,053,548 | A | | 4/2000 | Bowles, Jr. | |
| 6,435,580 | B1 | | 8/2002 | Lock | |
| 6,497,439 | B1 | * | 12/2002 | Guo | 294/54.5 |
| 6,792,829 | B1 | * | 9/2004 | Garcia et al. | 81/45 |
| 2001/0029685 | A1 | | 10/2001 | Hendrick | |

* cited by examiner

*Primary Examiner*—Eileen D. Lillis
*Assistant Examiner*—Esther Onyinyechi Okezie
(74) *Attorney, Agent, or Firm*—Michael I Kroll

(57) ABSTRACT

Apparatus 10 for a shovel designed for moving snow 14 tangentially while the shovel moves longitudinally along the ground thereby eliminating the need for lifting the shovel during snow removal. The snow shovel of the present invention 10 comprises a latitudinal curved blade 12 with opposing end terminus arcs 40, 42 of differing degrees whereby shoveled material will move from one side of the blade to the other. On the back side of the blade 12 are longitudinal and latitudinal ribs 24 forming an integral part therewith providing reinforcement terminating in a centrally disposed receptacle for a handle mounting plate 30. The handle mounting plate 30 has mating apertures 34 for fixedly fastening the mounting plate to the curved blade 12. Positioned at the apex of the handle plate 30 is a post 46 for press fitting the handle plate to the shaft. The handle grip member 18 also has a post 44 that is inserted into the opposing end of the handle shaft 20.

4 Claims, 10 Drawing Sheets

SNOW SHOVEL

BACKGROUND OF THE INVENTION

1. Field of the Invention

The present invention relates generally to tools and, more specifically, to a shovel designed for moving snow tangentially while the shovel moves longitudinally thereby eliminating the need for lifting the shovel during snow removal. The snow shovel of the present invention comprises a latitudinal curved blade with opposing end terminus arcs of differing degrees whereby shoveled material will move from one side of the blade to the other. On the back side of the blade are longitudinal and latitudinal ribs forming an integral part therewith providing reinforcement terminating in a centrally disposed receptacle for a handle mounting plate.

The handle mounting plate has mating apertures for fixedly fastening the mounting plate to the curved blade. Positioned at the apex of the handle plate is a post for press fitting the handle plate to the shaft.

The handle grip member also has a post that is inserted into the opposing end of the handle shaft.

The present invention provides means for manufacturing a snow shovel in a lightweight polymeric material that will not deform under load, a property normally associated with metal blades, while the snow moves from one side of the blade to the other due to the decreasing blade face arc.

2. Description of the Prior Art

There are other shovel device designed for snow removal. Typical of these is U.S. Pat. No. 841,848 issued to Conner et al. on Jan. 22, 1907.

Another patent was issued to Pollack on Jul. 28, 1959 as U.S. Pat. No. 2,896,993. Yet another U.S. Pat. No. 583,747 was issued to Lambert on Jun. 8, 1971 and still yet another was issued on Apr. 22, 1980 to Winfred A. Mason as U.S. Pat. No. 4,199,181.

Another patent was issued to Zan on Nov. 2, 1999 as U.S. Pat. No. 5,975,602. Yet another U.S. Pat. No. 6,052,548 was issued to Bowles, Jr. on Apr. 25, 2000. Another was issued to Lock on Aug. 20, 2002 as U.S. Pat. No. 6,435,580 and still yet another was published on Oct. 18, 2001 to Hendrick as U.S. Patent Publication No. 2001/0029685.

Another patent was issued to Walker on Mar. 19, 1975 as U.K. Patent No. GB1 387 561 and still yet another was issued on Oct. 2, 1991 to Short as U.K. Patent No. GB2 242 466.

A walk-cleaner comprising a body of thin sheet material, in form the segment of a cylinder, whose length from end to end is considerably greater than its width, one of whose side margins is adapted to bear on its extreme edge and throughout its length, on the convex face, along the ground, one of the ends being closed by a thin sheet cross-partition secured at its margins to the end margin, and the other end being provided with an outwardly-flaring margin, and a handle secured at its lower end tangentially against the convex side of the body by a shield.

In a manually operated push type shovel having a blade and handle extending therefrom, a means to selectively turn said blade to the right and left relative to the direction of travel while said blade is being pushed, said means comprising a tubular collar pivotally secured at one end to the rear of said blade so as to limit said collar to only a lateral pivotal movement relative to said blade, a pair of rigid braces each pivotally connected at one respective end to opposite end portions of said blade on the rear side thereof, said braces converging rearwardly of said blade with their other respective ends being pivotally connected at a point spaced below said collar, a rigid strap connected at one end to said handle and pivotally connected at the other end to the converged ends of said braces, one end portion of said handle slidably rotatably disposed within said collar, and said handle rotatable about its longitudinal axis in two opposite directions respectively whereby said converged ends of said braces will move in the opposite direction said handle is rotated and said blade is turned in the direction of the rotation.

Snow removing apparatus comprising:

a. a blade having a snow-engaging surface along one edge thereof;

b. a handle; and c. mounting means pivotally mounting one end of said handle to said blade so that in use said blade will be in an open position at a generally right angle to said handle when said blade is moved in one direction and said blade will be in a closed position generally parallel to said handle when said blade is moved in an opposite direction said mounting means including a longitudinally extended channel having a U-shaped section with generally parallel sidewall portions and a connecting wall portion with means connecting one end of said channel to said blade whereby said channel extends longitudinally outwardly generally perpendicular to said blade, and wherein one end of said handle is pivotally mounted in said channel adjacent said blade, said handle being pivotal about an axis generally perpendicular to the parallel sidewalls of said channel.

A device for removing snow from sidewalks, driveways, and the like. The device is used principally as a plow for pushing the snow off to one side of a snow-covered path. Force which is applied through the handle of the device is distributed over the blade equally so that the blade will not veer from the path to be plowed. The blade is formed from a trapezoidal blank and is diagonally curved to give a sidewise thrust to the snow as it is pushed along the path to be cleaned.

A snow shovel construction 10 including a curved and tapered blade member 20 having an enlarged end 21 and a smaller end 22. The blade member 20 is disposed at an angle of approximately 60. degree. relative to a handle member 30 that is provided with a pair of offset hand grip elements 33, 34 and further provided with a reinforcement unit 13 disposed both on the blade member 20 and between the blade member 20 and the handle member 30.

A manually-operable shovel for efficiently moving material, including a shovel blade, a shovel handle, a joint for attaching the shovel blade to the shovel handle, and an articulation device cooperating with the joint for permitting the operator to position the blade to a predetermined fixed angle in relation to the direction of blade movement for moving the material in a predetermined desired relation to the direction of blade movement. The articulation device is moveable between an unlocked position wherein the angle of the blade in relation to the direction of blade movement is variable and a locked position wherein the angle of the blade is locked into a fixed angle in relation to the direction of blade movement. The articulation device automatically assumes the locked position during a forward, material engaging movement of the shovel and automatically assumes the unlocked position during a rearward material disengaging, movement of the shovel.

The invention relates to a shovel particularly useful for snow removal. The shovel is characterized by dual ground contacting edges allowing the shovel to be self-supporting and which allows the shovel to be used in an ergonomically efficient manner for removing snow from a surface.

A snow shoveling apparatus includes a handle mounted to an intermediate portion of a base of a mobile frame such that the handle can undergo pivotal movement between selected vertical angles relative to the base, a tool mounted to a front end of the base such that the tool can undergo pivotal movement between selected horizontal angles relative to the base, a handle angle adjustment mechanism adapted to undergo relative reciprocal movement between latched and unlatched positions so as to allow changing of the vertical angle of the handle relative to the base when the mechanism is in the unlatched position and to hold the handle at a selected one of the vertical angles relative to the base when the mechanism is in the latched position, and a tool angle adjustment mechanism adapted to undergo relative pivotal movement between latched and unlatched positions as to allow changing of the horizontal angle of the tool relative to the base when the mechanism is in the unlatched position and to hold the tool at a selected one of the horizontal angles relative to the base when the mechanism is in the latched position.

An implement for clearing snow and other debris comprises an elongate blade which is wider at one end than at the other, the wider end being nearer the handle 18. The blade 10 is arcuate about its longitudinal axis the handle 18 being attached to the convex face of the blade 10. The blade 10 may be provided with at least one strengthening rib 16 and is preferably of steel.

A snow plough with an angled blade 10 so that snow is pushed to one side suitable for hand operation by pushing it along on the end of a broomstick 11.

While these shovel devices may be suitable for the purposes for which they were designed, they would not be as suitable for the purposes of the present invention, as hereinafter described.

SUMMARY OF THE PRESENT INVENTION

The present invention discloses a shovel designed for moving snow tangentially while the shovel moves longitudinally along the ground thereby eliminating the need for lifting the shovel during snow removal. The snow shovel of the present invention comprises a latitudinal curved blade with opposing end terminus arcs of differing degrees whereby shoveled material will move from one side of the blade to the other. On the back side of the blade are longitudinal and latitudinal ribs forming an integral part therewith providing reinforcement terminating in a centrally disposed receptacle for a handle mounting plate. The handle mounting plate has mating apertures for fixedly fastening the mounting plate to the curved blade. Positioned at the apex of the handle plate is a post for press fitting the handle plate to the shaft. The handle grip member also has a post that is inserted into the opposing end of the handle shaft.

A primary object of the present invention is to provide a snow shovel that eliminates the need for lifting snow from a surface to be cleaned.

Another object of the present invention is to provide a snow shovel that moves snow from one side of the shovel blade to the other.

Yet another object of the present invention is to provide a snow shovel having a curved blade with side terminus arcs of differing degrees.

Still yet another object of the present invention is to provide a snow shovel having spaced apart longitudinal and latitudinal ribs providing blade reinforcement.

Another object of the present invention is to provide a snow shovel having a mounting receptacle for a handle mounting plate.

Yet another object of the present invention is to provide a snow shovel having a handle mounting plate having blade mating apertures for fixedly positioning said plate to said handle.

Still yet another object of the present invention is to provide a snow shovel having a mounting plate with means for fastening a handle shaft thereto.

Another object of the present invention is to provide a snow shovel mounting plate having a post for mounting the handle shaft thereon.

Yet another object of the present invention is to provide a handle grip that can be fastened to the handle shaft.

Still yet another object of the present invention is to provide a post depending from the handle grip for inserting the grip into the handle shaft.

Additional objects of the present invention will appear as the description proceeds.

The present invention overcomes the shortcomings of the prior art by providing a shovel designed for moving snow tangentially while the shovel moves longitudinally thereby eliminating the need for lifting the shovel during snow removal. The snow shovel has a curved blade with opposing end terminus arcs of differing degrees that will move shoveled material from one side of the blade to the other as the shovel is propelled in a forward direction. Integral ribs are formed on the bask of the blade providing reinforcement along with a centrally disposed receptacle for attaching a handle mounting plate.

The handle mounting plate has mating apertures for fixedly fastening the mounting plate to the curved blade. Positioned at the apex of the handle plate is a post for fastening the handle shaft.

The handle grip member also has a post that is inserted into the opposing end of the handle shaft.

The present invention provides means for manufacturing a snow shovel in a lightweight polymeric material that will not deform under load, a property normally associated with metal blades, while the snow moves from one side of the blade to the other due to the decreasing blade face arc.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
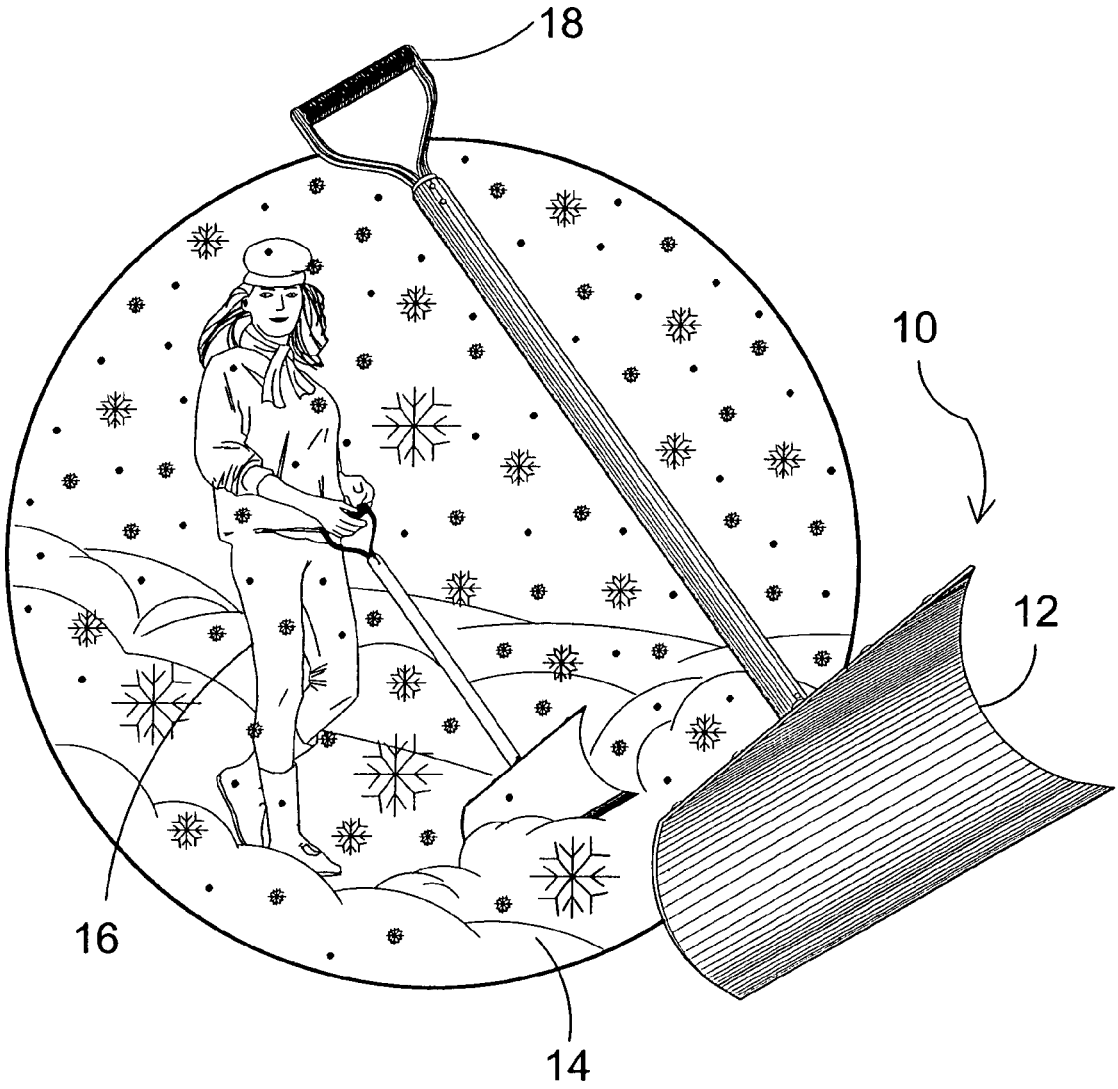
FIG. 1 is an illustrative view of the present invention in use.

With regard to reference numerals used, the following numbering is used throughout the drawings.

10 present invention
12 blade
14 snow
16 user
18 handle
20 shaft
22 reinforcement element
24 reinforcement ribbing
26 shaft mounting holes
28 handle mounting holes
30 plate
32 mounting structure
34 mounting holes
36 mounting hardware
38 shaft mounting holes
40 smaller arc
42 larger arc
44 post
46 post

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a snow shovel having a reinforcement element forming an integral part of the blade portion 12, the shovel having a handle attachment plate. The device 10 is designed for the removal of snow 14 and enables the user 16 to displace the snow to one side instead of physically lifting the snow. The main body of the device 10 is made of durable wear resistant injection molded polymeric material. The handle 18 is designed with an extra wide d-type handle which enables the user to use both hands when pushing and comfortable enough to be used as a shovel.

Figure 2:
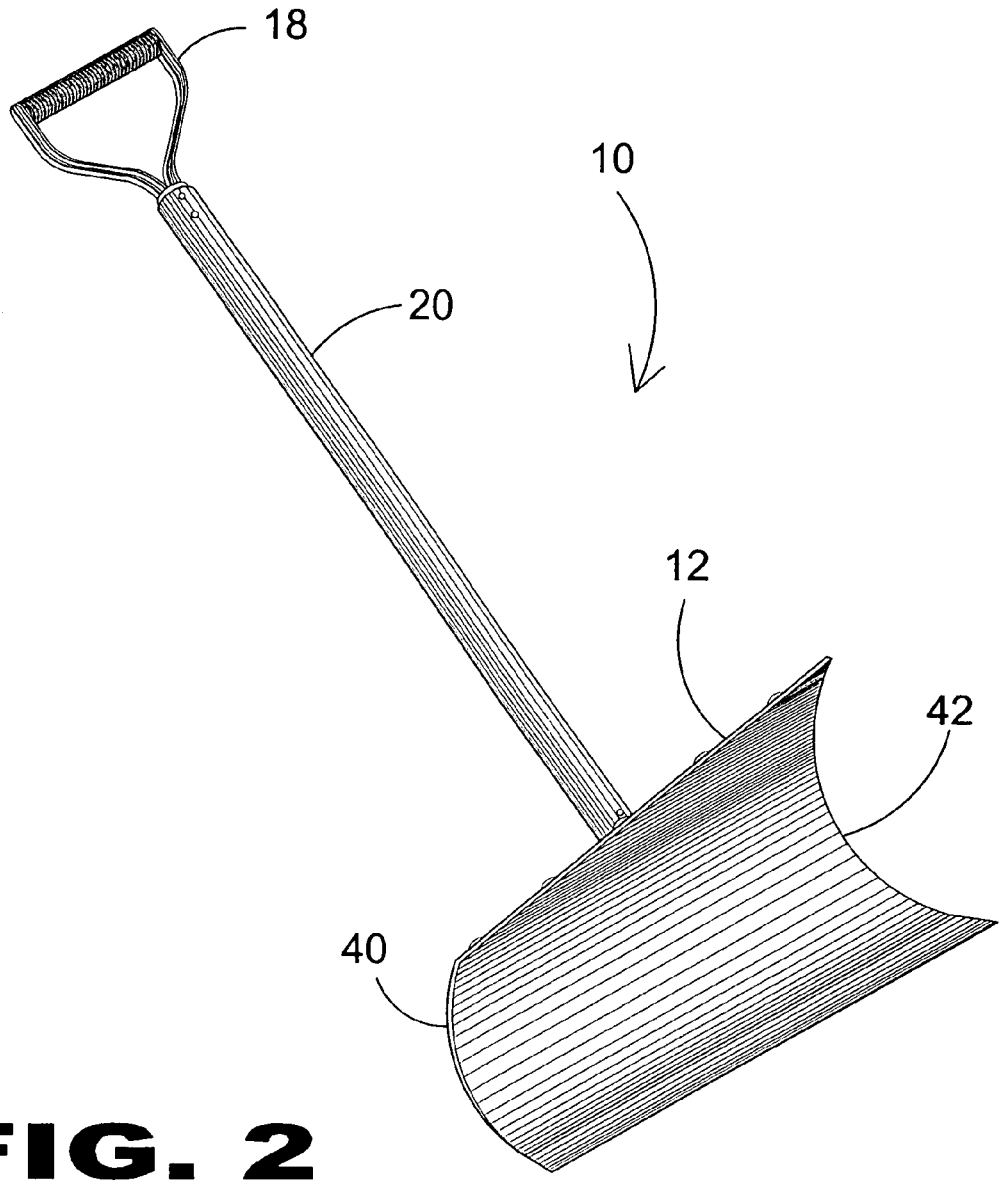
FIG. 2 is a perspective view of the present invention.

Turning to FIG. 2, shown therein is a perspective view of the present invention 10. Shown is a perspective view of the present invention 10 disclosing a snow shovel having a reinforcement element forming an integral part of the blade portion 12, the shovel having a handle attachment plate. The blade 12 has a smaller arc 40 and a larger arc 42 on opposite ends so that snow moves toward the smaller arc 40. The device 10 is designed for the removal of snow and enables the user to displace the snow to one side instead of physically lifting the snow. The main body of the device 10 is made of durable wear resistant injection molded polymeric material. The handle 18 on one end of shaft 20 is designed with an extra wide d-type handle which enables the user to use both hands when pushing and comfortable enough to be used as a shovel.

Figure 3:
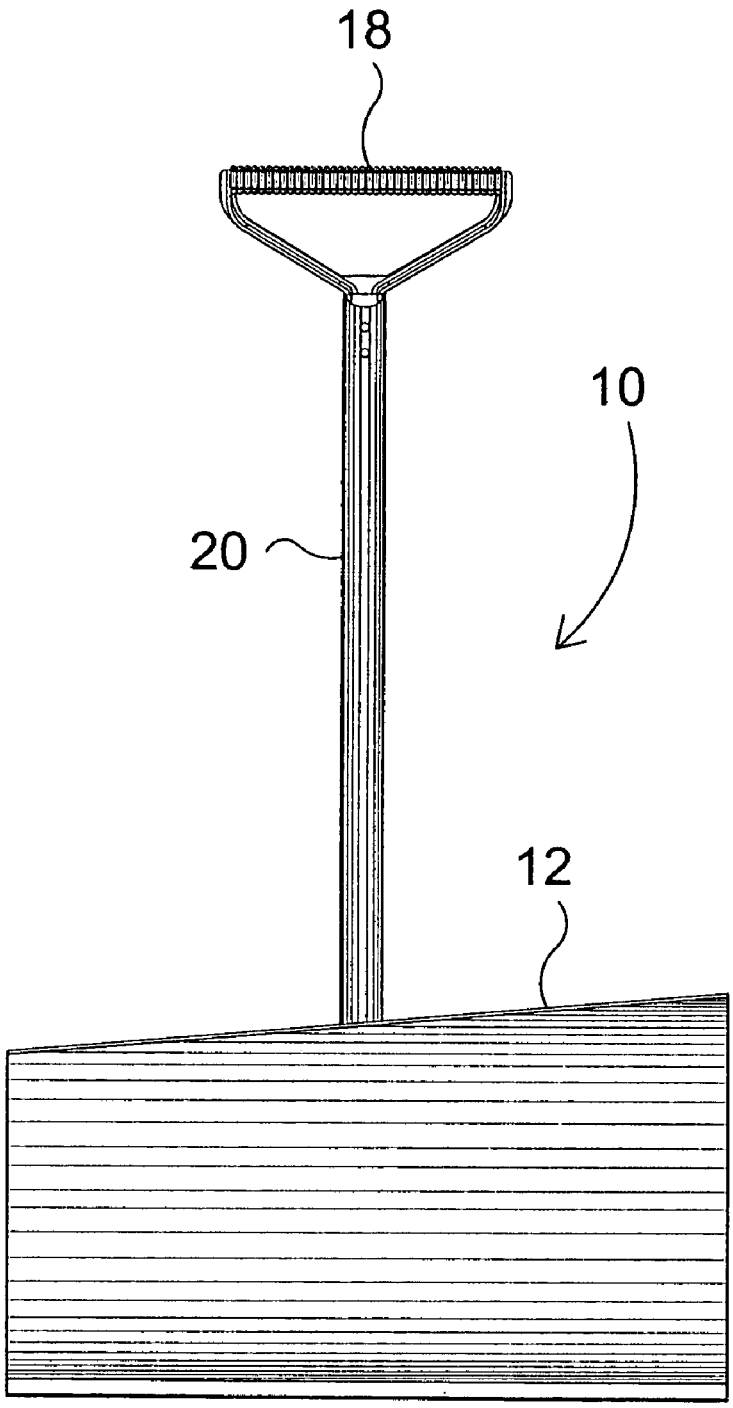
FIG. 3 is a front view of the present invention.

Turning to FIG. 3, shown therein is a front view of the present invention 10. Shown is a front view of the present invention 10 disclosing a snow shovel having a reinforcement element forming an integral part of the blade portion 12, the shovel having a handle attachment plate. The device 10 is designed for the removal of snow and enables the user to displace the snow to one side instead of physically lifting the snow. The main body of the device 10 is made of durable wear resistant injection molded polymeric material. The handle 18 on shaft 20 is designed with an extra wide d-type handle which enables the user to use both hands when pushing and comfortable enough to be used as a shovel.

Figure 4:
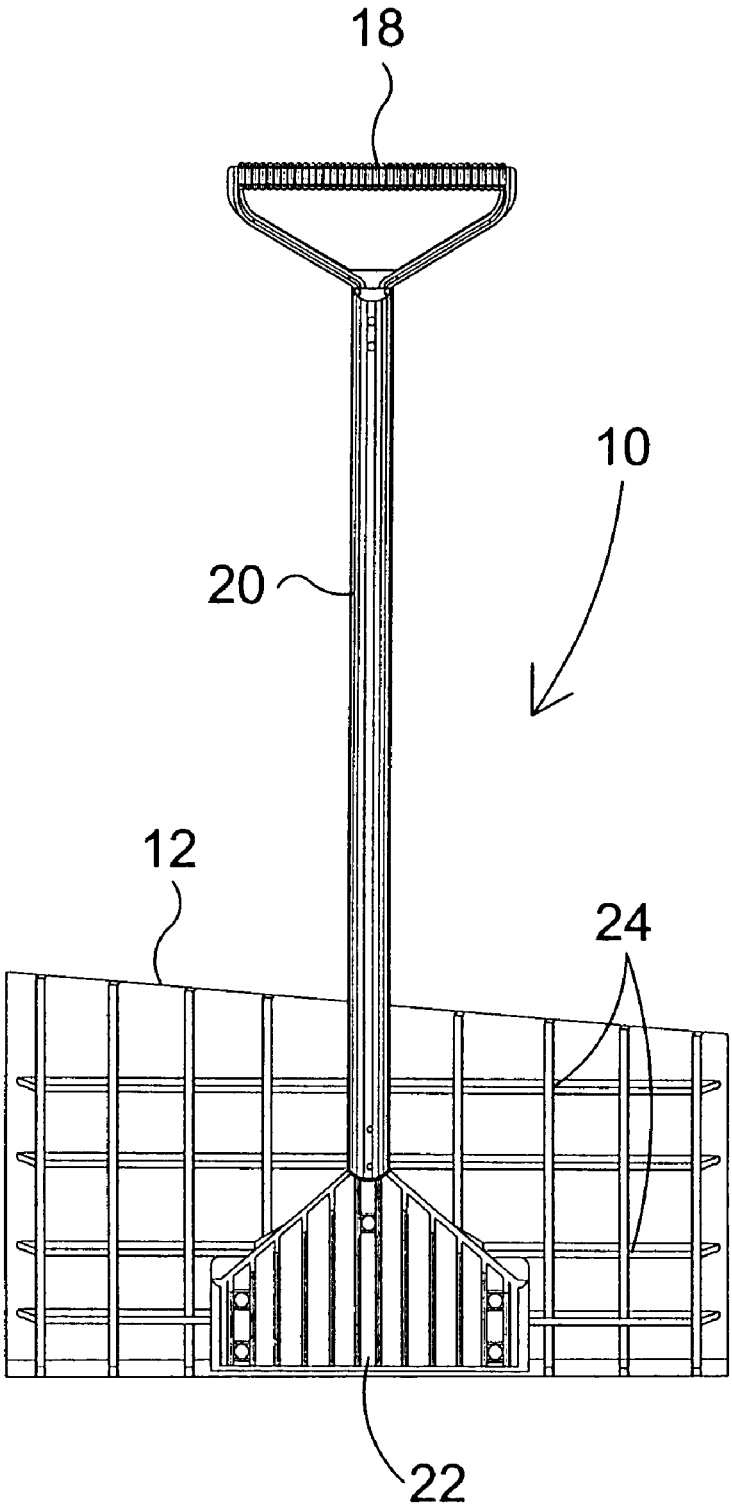
FIG. 4 is a rear view of the present invention.

Turning to FIG. 4, shown therein is a rear view of the present invention 10. Shown is a rear view of the present invention 10 disclosing a snow shovel having a reinforcement element 22 forming an integral part of the blade portion 12, the shovel having a handle attachment plate. The device 10 is designed for the removal of snow and enables the user to displace the snow to one side instead of physically lifting the snow. The main body of the device 10 is made of durable wear resistant injection molded polymeric material. The handle 18 on shaft 20 is designed with an extra wide d-type handle which enables the user to use both hands when pushing and comfortable enough to be used as a shovel. Also shown are longitudinal and latitudinal reinforcement ribbing 24.

Figure 5:
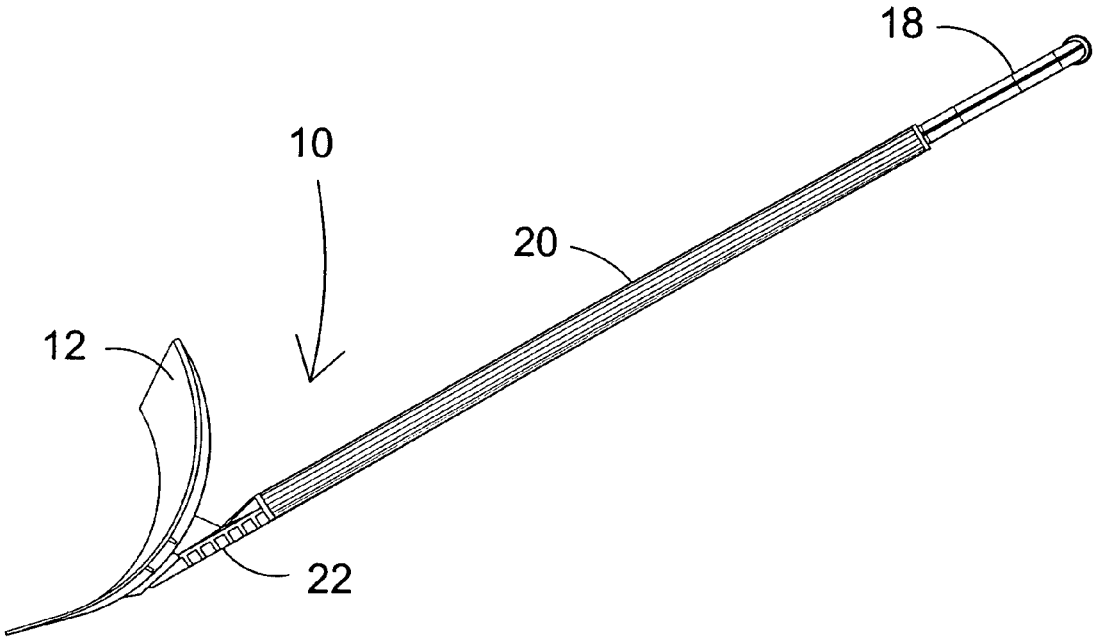
FIG. 5 is a side view of the present invention.

Turning to FIG. 5, shown therein is a side view of the present invention 10. Shown is a side view of the present invention 10 disclosing a snow shovel having a reinforcement element 22 forming an integral part of the rear side of blade portion 12, the shovel having a handle attachment plate. The device 10 is designed for the removal of snow and enables the user to displace the snow to one side instead of physically lifting the snow. The main body of the device 10 is made of durable wear resistant injection molded polymeric material. The handle 18 on shaft 20 is designed with an extra wide d-type handle which enables the user to use both hands when pushing and comfortable enough to be used as a shovel.

Figure 6:
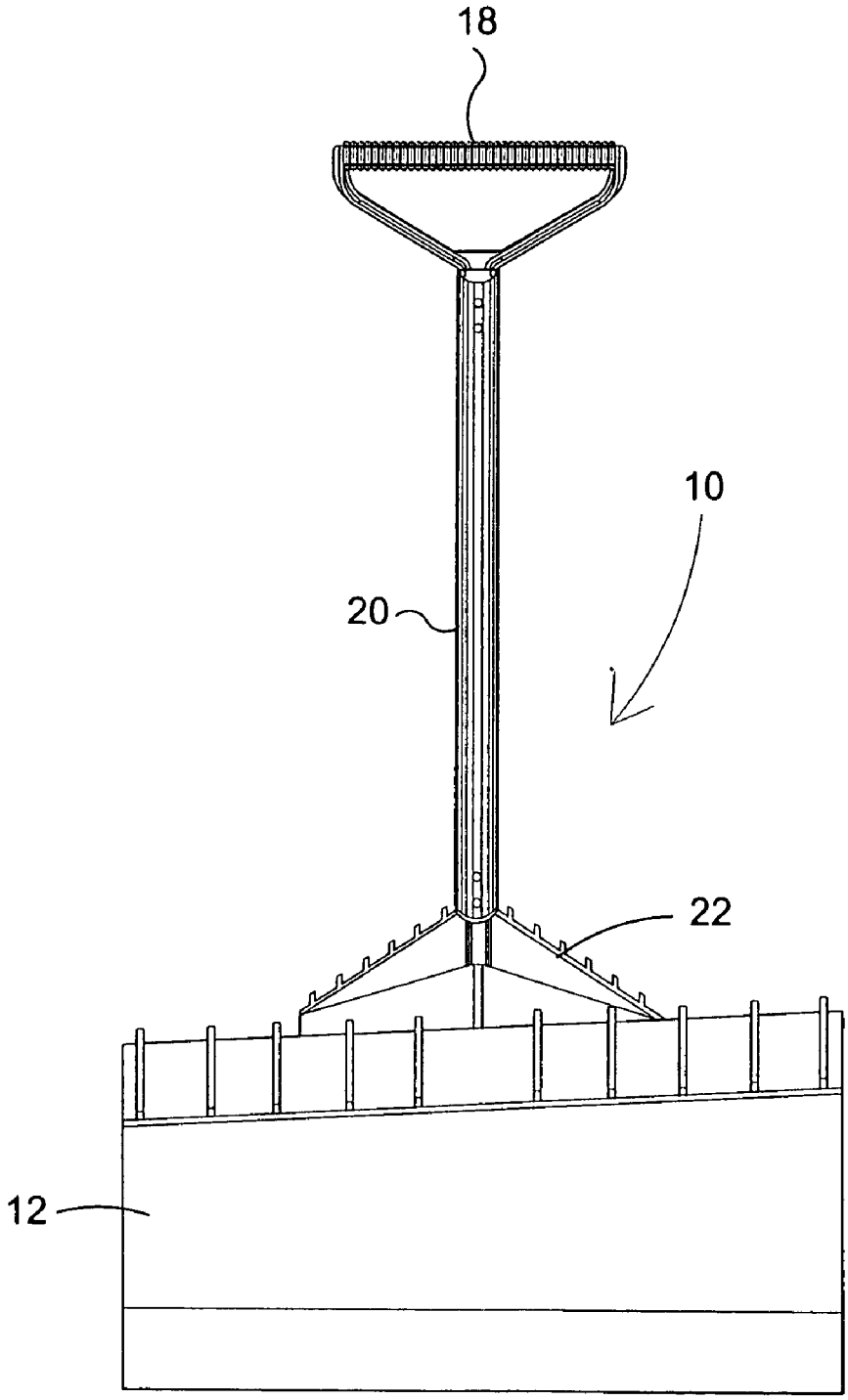
FIG. 6 is an off angle view of the present invention.

Turning to FIG. 6, shown therein is an off angle view of the present invention 10. Shown is an off angle view of the present invention 10 disclosing a snow shovel having a reinforcement element 22 forming an integral part of the blade portion 12, the shovel having a handle attachment plate. The device 10 is designed for the removal of snow and enables the user to displace the snow to one side instead of physically lifting the snow. The main body of the device 10 is made of durable wear resistant injection molded polymeric material. The handle 18 on shaft 20 is designed with an extra wide d-type handle which enables the user to use both hands when pushing and comfortable enough to be used as a shovel.

Figure 7:
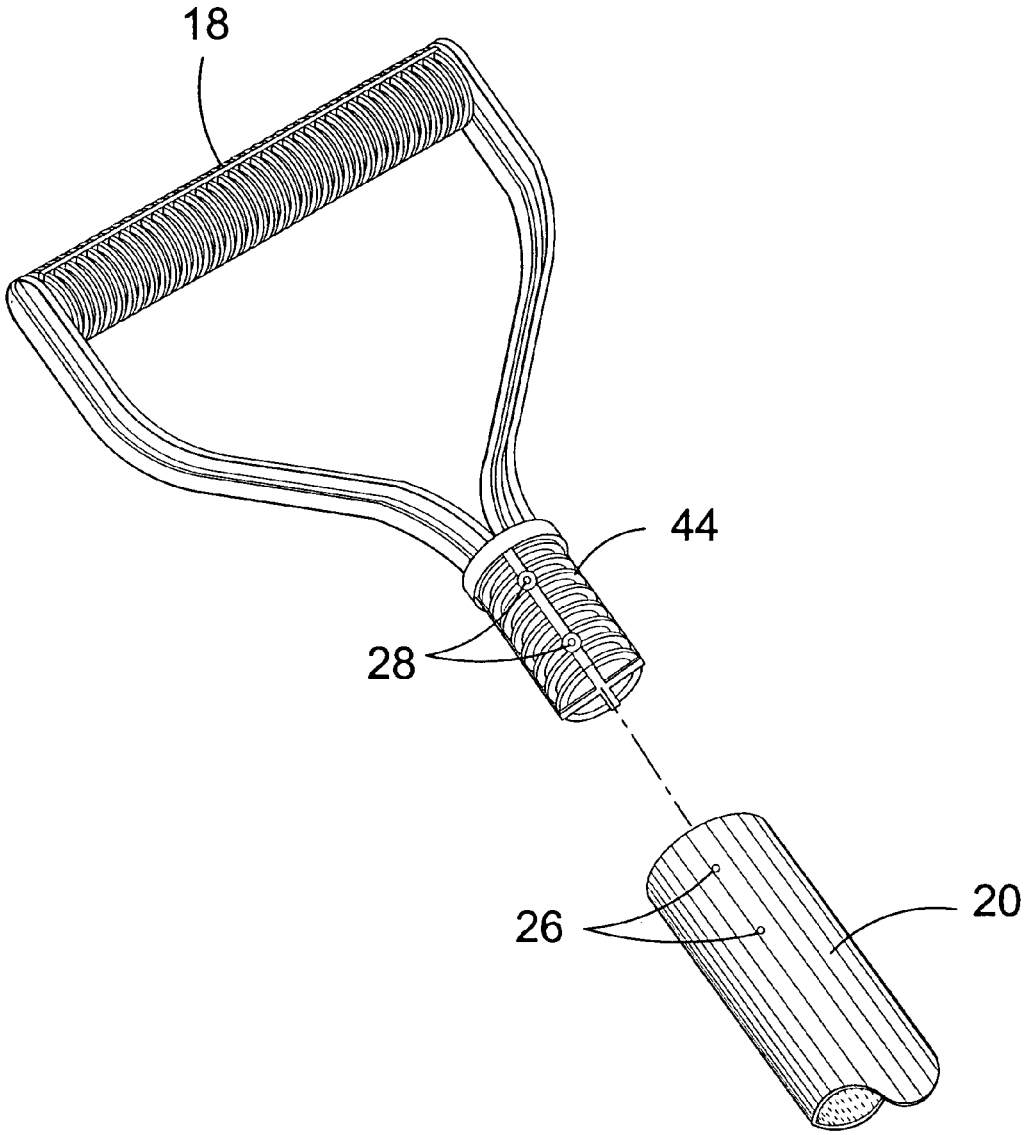
FIG. 7 shown therein is a detail view of the handle of the present invention.

Turning to FIG. 7, shown therein is a detail view of the handle 18 of the present invention. Shown is a detail view of the present invention 10 disclosing a snow shovel having a reinforcement element forming an integral part of the blade portion, the shovel having a handle attachment plate. The device 10 is designed for the removal of snow and enables the user to displace the snow to one side instead of physically lifting the snow. The main body of the device 10 is made of durable wear resistant injection molded polymeric material. The handle 18 on shaft 20 is designed with an extra wide d-type handle, which enables the user to use both hands when pushing and comfortable enough to be used as a shovel. The wall of shaft 20 has mounting holes 26 for mating with handle mounting holes 28 disposed on post 44.

Figure 8:
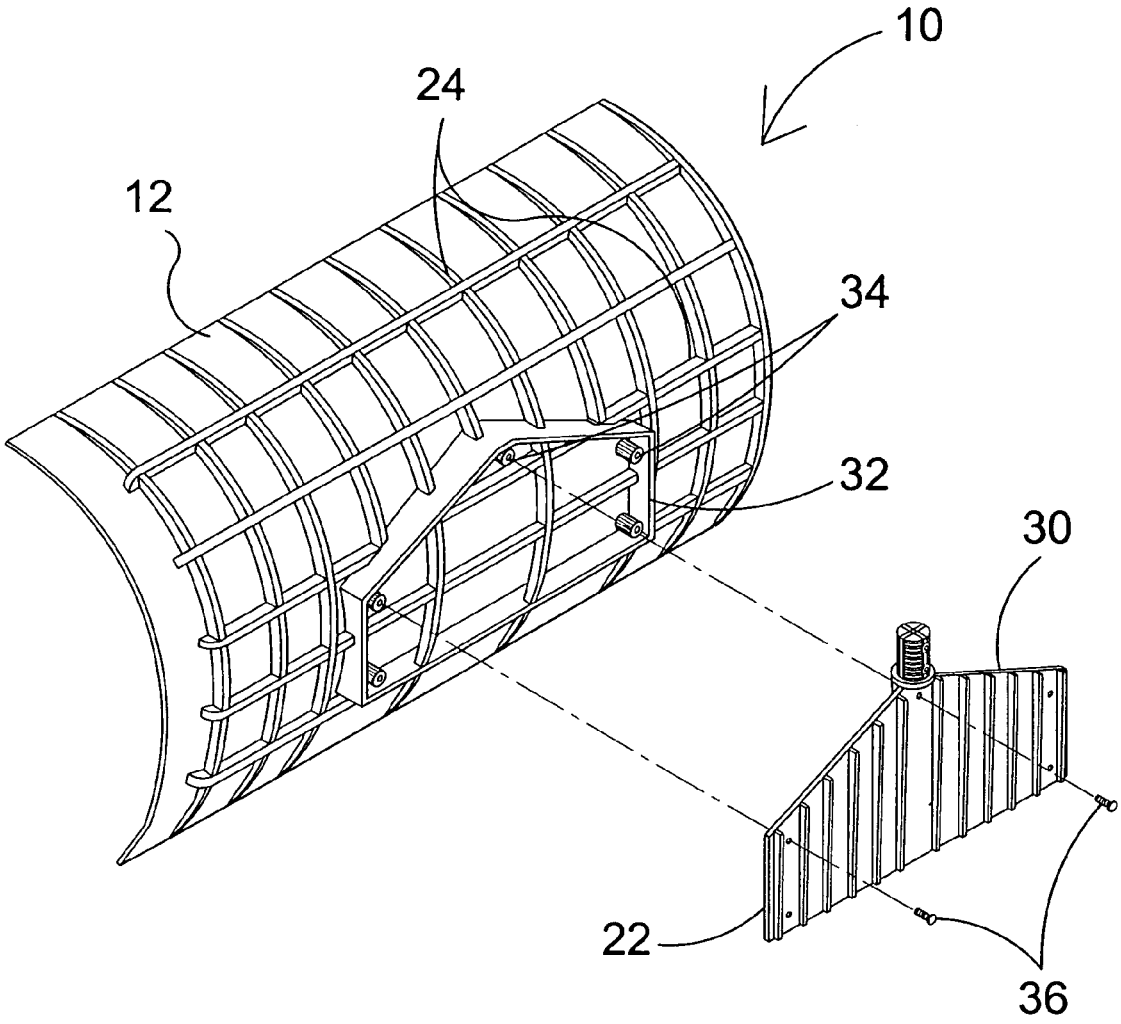
FIG. 8 is an exploded view of the reinforcement element of the present invention.

Turning to FIG. 8, shown therein is an exploded view of the reinforcement element of the present invention 10. Shown is an exploded view of the present invention 10 disclosing a snow shovel having a reinforcement element 22 forming an integral part of the blade portion 12, the shovel having a handle attachment plate 30 which attaches to the reinforcement mounting structure 32 using mounting holes 34 and mounting hardware 36. The device 10 is designed for the removal of snow and enables the user to displace the snow to one side instead of physically lifting the snow. The main body of the device 10 is made of durable wear resistant injection molded polymeric material. The handle is designed with an extra wide d-type handle which enables the user to use both hands when pushing and comfortable enough to be used as a shovel. Also shown are reinforcement ribs 24.

Figure 9:
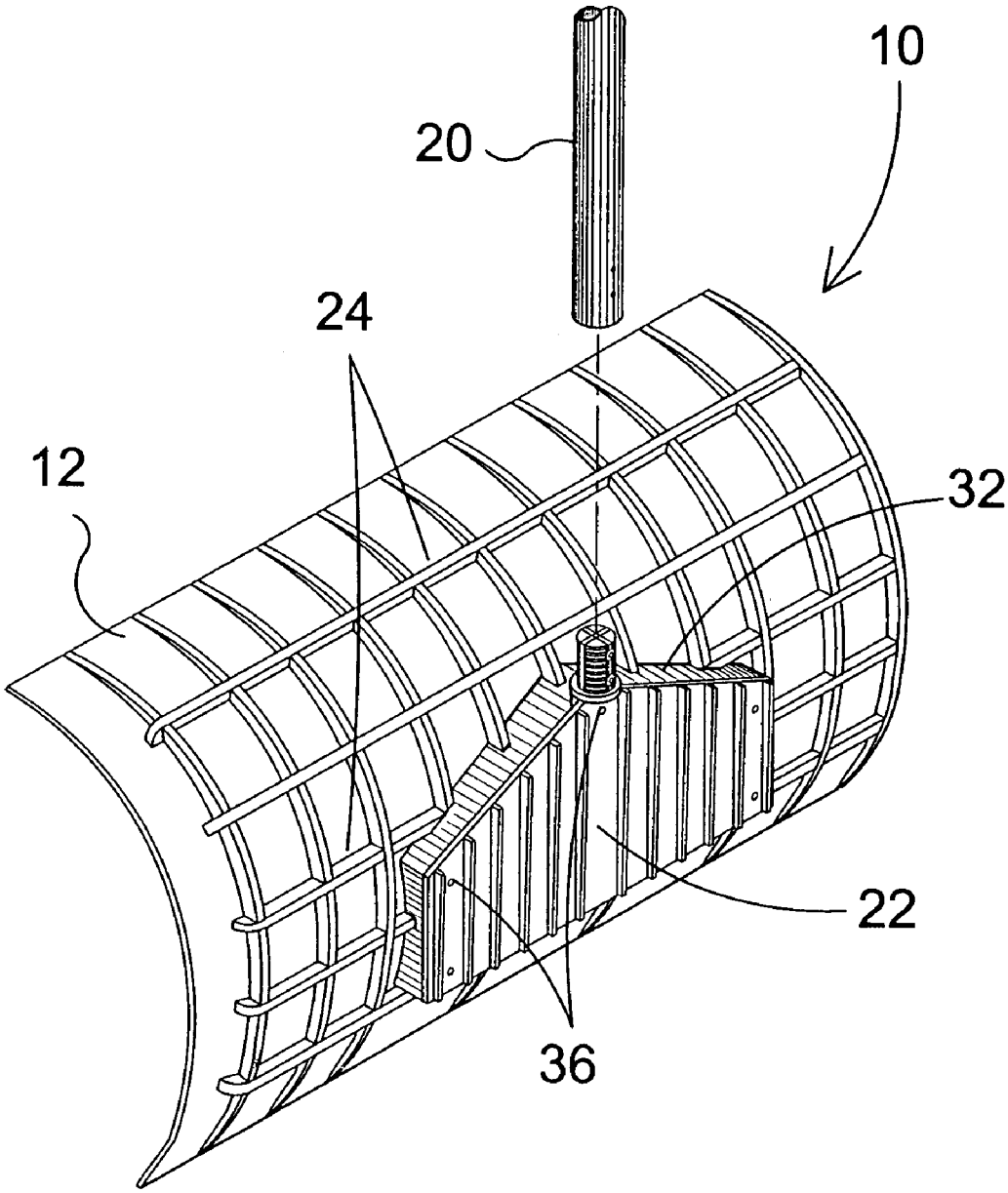
FIG. 9 is a perspective view of the reinforcement element of the present invention.

Turning to FIG. 9, shown therein is a perspective view of the reinforcement element of the present invention 10. Shown is a perspective view of the present invention 10 disclosing a snow shovel having a reinforcement element 22 forming an integral part of the blade portion 12, the shovel having a handle attachment plate. The device 10 is designed for the removal of snow and enables the user to displace the snow to one side instead of physically lifting the snow. The main body of the device 10 is made of durable wear resistant injection molded polymeric material. The handle is designed with an extra wide d-type handle which enables the user to use both hands when pushing and comfortable enough to be used as a shovel. Also shown are shaft 20, reinforcement ribbing 24, reinforcement mounting structure 32 and mounting hardware 36.

Figure 10:
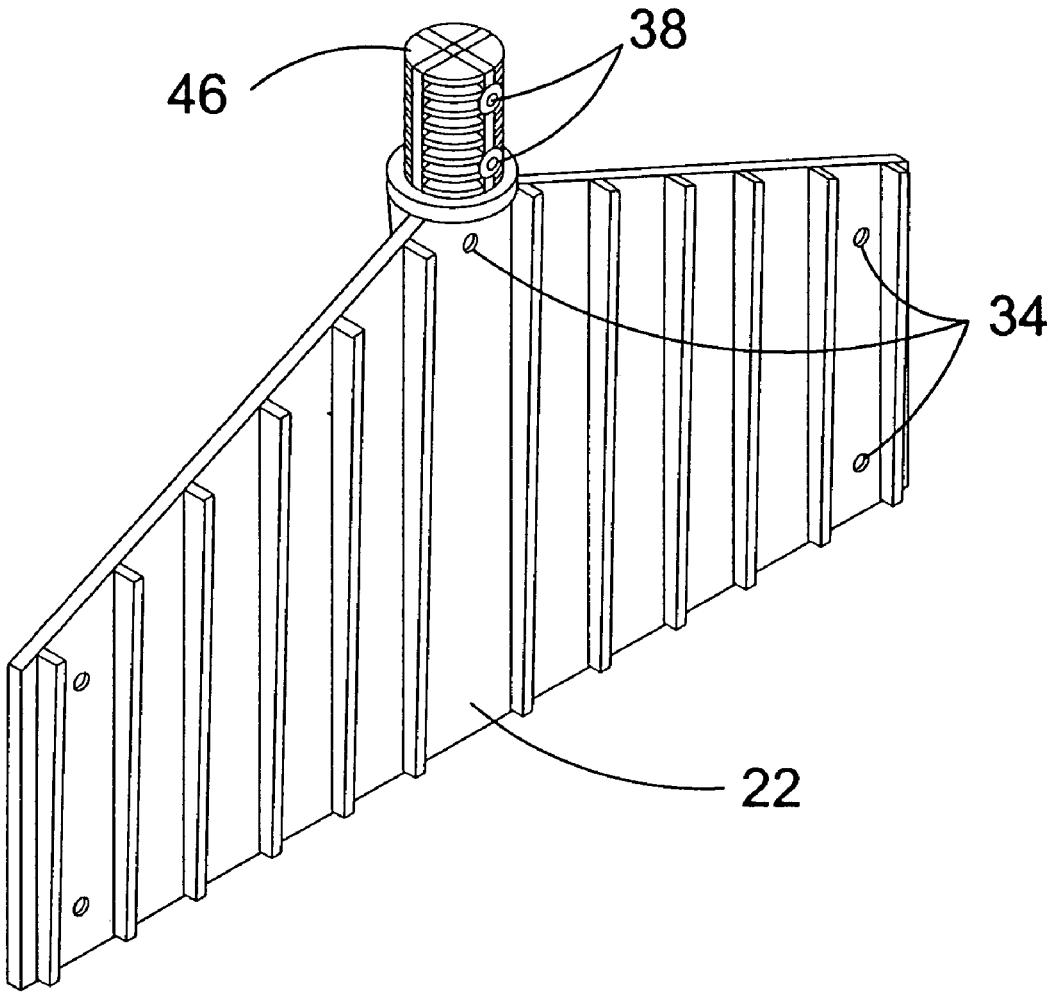
FIG. 10 is a detail view of the reinforcement element of the present invention.

Turning to FIG. 10, shown therein is a detail view of the reinforcement element 22 of the present invention. Shown is a detail view of the present invention, a snow shovel having a reinforcement element 22 forming an integral part of the blade portion, the shovel having a handle attachment plate. The device is designed for the removal of snow and enables the user to displace the snow to one side instead of physically lifting the snow. The main body of the device is made of durable wear resistant injection molded polymeric material. The handle is designed with an extra wide d-type handle, which enables the user to use both hands when pushing and comfortable enough to be used as a shovel. Also shown are mounting holes 34 and shaft mounting holes 38 on post 46.

We claim:

1. A shovel for snow, comprising:

a) a blade, wherein said blade is concave, said blade having a top and bottom edge, a front and rear surface, and a first and second end to permit snow to be shoveled;

b) wherein said first end of said blade has a smaller arc than said second end of said blade so that the snow will move from said second end to said first end of said blade as said blade is moved along the ground;

c) a plurality of reinforcement ribs being disposed on said rear surface of said blade to permit the blade to be structurally strengthened;

d) a D-shaped handle to permit the shovel to be gripped by a user;

e) a straight shaft having first and second ends, wherein said first end is adapted for connection to said handle and said second end is adapted for connection to said rear surface of said blade to permit the blade to be pushed by a user while gripping the handle; and f) a flat mounting plate located on said rear surface of said blade, said mounting plate having a straight bottom edge substantially aligned with and adjacent the bottom edge of said blade, said plate extending tangentially away from said blade, said second end of said shaft being attached only to a top edge of said mounting plate so that said shaft along with said plate extends tangentially away from said blade aligned with the bottom edge of said blade;

g) a reinforcement mounting structure comprising a wall on said rear surface of said blade completely surrounding said flat mounting plate, h) said reinforcement ribs comprising latitudinal and longitudinal ribs passing through said wall; and i) fastening posts extending out from said blade within said mounting structure for accommodating threaded holes and a plurality of fasteners for connection of said mounting plate to said mounting structure, wherein said fasteners pass through holes in said mounting plate to threadably engage said threaded holes in said fastening posts.

2. The shovel of claim 1, further comprising a shaft post disposed on said mounting plate, said shaft post having a plurality of holes therein, wherein said second end of said shaft is hollow having a wall thereon, wherein said wall of said shaft has a plurality of holes therein, wherein said first post extends into said hollow second end of said shaft, wherein said holes in said shaft post and shaft wall are co-aligned for receiving a fastener therein to permit the mounting plate to be connected to the shaft.

3. The shovel of claim 2, wherein said handle has a first and second end, wherein a grip is disposed on said first end, wherein said grip is sized to allow a user to place two hands thereon, wherein a post is disposed on said second end for connection to said first end of said shaft, said first end of said shaft having an opening to receive the handle post, both the handle post and the first end of said shaft having holes to receive a fastener to attach said handle to said shaft.

4. The shovel of claim 3, wherein the shovel is made of polymeric material to permit the shovel to be lightweight.

* * * * *